US009107466B2

(12) United States Patent
Hoying et al.

(10) Patent No.: US 9,107,466 B2
(45) Date of Patent: Aug. 18, 2015

(54) BATTING HELMET HAVING LOCALIZED IMPACT PROTECTION

(75) Inventors: Brian Hoying, Saint Louis, MO (US); Kevin Bowman, Washington, MO (US); Art Chou, Clarkson Valley, MO (US); Michael A. Lorenz, Gahanna, OH (US); Kevin J. Vititoe, Columbus, OH (US)

(73) Assignee: RAWLINGS SPORTING GOODS COMPANY, INC., St. Louis, MO (US)

( * ) Notice: Subject to any disclaimer, the term of this patent is extended or adjusted under 35 U.S.C. 154(b) by 1092 days.

(21) Appl. No.: 12/550,514

(22) Filed: Aug. 31, 2009

(65) Prior Publication Data

US 2011/0047680 A1 Mar. 3, 2011

(51) Int. Cl.
*A42B 3/06* (2006.01)
*A42B 3/12* (2006.01)

(52) U.S. Cl.
CPC . *A42B 3/128* (2013.01); *A42B 3/06* (2013.01); *A42B 3/069* (2013.01)

(58) Field of Classification Search
CPC ..... A42B 3/06; A42B 3/16; A42B 3/00; A42B 3/128; A42B 3/12; A42B 3/061; A42B 3/062; A42B 3/063; A42B 3/065; A42B 3/069
USPC ..... 2/410, 5, 6.6, 411, 412, 422, 423, 425, 2/6.1, 6.2, 413, 414, 415, 424; D29/102, D29/103, 106, 122
See application file for complete search history.

(56) References Cited

U.S. PATENT DOCUMENTS

| | | | | | |
|---|---|---|---|---|---|
| 645,286 | A | * | 3/1900 | Bader | 128/201.23 |
| 1,669,914 | A | | 5/1928 | Rogers | |
| 2,081,335 | A | * | 5/1937 | Levinson | 2/412 |
| 2,351,235 | A | * | 6/1944 | Shroyer et al. | 2/5 |
| 2,889,555 | A | * | 6/1959 | Stuart et al. | 2/6.6 |
| 3,174,155 | A | * | 3/1965 | Pitman | 2/411 |
| D202,539 | S | * | 10/1965 | Webb et al. | D29/102 |
| 3,239,842 | A | * | 3/1966 | Marchello | 2/422 |
| 3,435,460 | A | * | 4/1969 | Grant | 2/422 |
| 3,447,163 | A | | 6/1969 | Bothwell et al. | |
| 4,223,409 | A | * | 9/1980 | Lee | 2/411 |
| 4,239,106 | A | | 12/1980 | Aileo | |
| 4,242,406 | A | | 12/1980 | El Bouhnini et al. | |
| 4,290,149 | A | | 9/1981 | Aileo | |
| 4,375,108 | A | | 3/1983 | Gooding | |

(Continued)

FOREIGN PATENT DOCUMENTS

| | | | |
|---|---|---|---|
| DE | 29906225 | U1 * | 8/1999 |
| EP | 1016352 | | 12/1998 |

(Continued)

OTHER PUBLICATIONS

Article "Molded in the Shell", from Bicycle Helmet Safety Institute, downloaded from internet on Aug. 1, 2011 at www.helmets.org/molded.htm (4 pgs) The website shows page was last revised on Jun. 14, 2005.

*Primary Examiner* — Amy Vanatta
(74) *Attorney, Agent, or Firm* — Stinson Leonard Street LLP

(57) ABSTRACT

A batting helmet having localized impact protection comprises a rigid shell with a padded inner core affixed therein. Localized impact protection comprises additional padding attached to the inner core, increased thickness of the rigid shell, increased stiffness of the rigid shell, and additional padding attached to the rigid shell, alone or in combination, positioned in various regions of the helmet.

18 Claims, 3 Drawing Sheets

(56) References Cited

U.S. PATENT DOCUMENTS

| | | | | |
|---|---|---|---|---|
| 4,660,230 | A * | 4/1987 | Mayling | 2/413 |
| 4,665,569 | A | 5/1987 | Santini | |
| 4,937,888 | A * | 7/1990 | Straus | 2/411 |
| 4,953,234 | A | 9/1990 | Li et al. | |
| 5,075,904 | A * | 12/1991 | Shirasaki et al. | 2/412 |
| 5,309,576 | A | 5/1994 | Broersma | |
| 5,327,588 | A | 7/1994 | Garneau | |
| 5,343,569 | A | 9/1994 | Asare et al. | |
| 5,351,341 | A | 10/1994 | Broersma | |
| 5,361,420 | A | 11/1994 | Dobbs et al. | |
| 5,537,687 | A | 7/1996 | Garza | |
| 5,544,367 | A | 8/1996 | March | |
| 5,794,271 | A | 8/1998 | Hastings | |
| 5,950,244 | A | 9/1999 | Fournier et al. | |
| 5,952,078 | A | 9/1999 | Park | |
| 5,953,762 | A * | 9/1999 | Corbett | 2/425 |
| 5,956,777 | A * | 9/1999 | Popovich | 2/424 |
| 6,029,283 | A * | 2/2000 | Comstock et al. | 2/422 |
| 6,052,835 | A * | 4/2000 | O'Shea | 2/468 |
| 6,070,271 | A | 6/2000 | Williams | |
| 6,219,850 | B1 | 4/2001 | Halstead et al. | |
| 6,272,692 | B1 * | 8/2001 | Abraham | 2/411 |
| 6,282,724 | B1 | 9/2001 | Abraham et al. | |
| 6,314,586 | B1 * | 11/2001 | Duguid | 2/411 |
| 6,332,228 | B1 * | 12/2001 | Takahara | 2/422 |
| 6,363,539 | B2 * | 4/2002 | Tachi et al. | 2/412 |
| 6,389,607 | B1 | 5/2002 | Wood | |
| 6,425,141 | B1 | 7/2002 | Ewing et al. | |
| 6,434,755 | B1 | 8/2002 | Halstead et al. | |
| 6,453,476 | B1 | 9/2002 | Moore | |
| 6,468,644 | B1 * | 10/2002 | Hong et al. | 428/297.7 |
| 6,550,071 | B2 * | 4/2003 | Garneau | 2/425 |
| 6,604,246 | B1 | 8/2003 | Obreja | |
| 6,676,884 | B2 | 1/2004 | Hong et al. | |
| 6,711,751 | B1 | 3/2004 | Muskovitz | |
| 6,854,133 | B2 | 2/2005 | Lee et al. | |
| 6,911,247 | B2 | 6/2005 | Howland | |
| 6,925,657 | B2 | 8/2005 | Takahashi et al. | |
| 7,062,795 | B2 | 6/2006 | Skiba et al. | |
| 7,089,602 | B2 | 8/2006 | Talluri | |
| 7,096,512 | B2 | 8/2006 | Blair | |
| 7,849,524 | B1 | 12/2010 | Williamson et al. | |
| 7,913,325 | B2 | 3/2011 | Bullock | |
| 7,979,918 | B2 | 7/2011 | Sandusky et al. | |
| RE43,173 | E * | 2/2012 | Ambuske et al. | 2/425 |
| 8,132,494 | B1 | 3/2012 | Nguyen et al. | |
| 2002/0184699 | A1 | 12/2002 | Ewing et al. | |
| 2003/0106137 | A1 * | 6/2003 | Penny | 2/412 |
| 2004/0168246 | A1 | 9/2004 | Phillips | |
| 2005/0283885 | A1 * | 12/2005 | Stroud et al. | 2/411 |
| 2006/0143807 | A1 * | 7/2006 | Udelhofen et al. | 2/425 |
| 2006/0248623 | A1 | 11/2006 | Miller | |
| 2006/0277664 | A1 * | 12/2006 | Akhtar et al. | 2/410 |
| 2007/0119538 | A1 * | 5/2007 | Price et al. | 156/242 |
| 2007/0220662 | A1 | 9/2007 | Pierce | |
| 2008/0028499 | A1 * | 2/2008 | Skottheim et al. | 2/414 |
| 2008/0092276 | A1 * | 4/2008 | Chiang | 2/418 |
| 2008/0092279 | A1 * | 4/2008 | Chiang | 2/425 |
| 2008/0256685 | A1 * | 10/2008 | Lampe et al. | 2/411 |
| 2009/0064385 | A1 | 3/2009 | Crossman et al. | |
| 2009/0151056 | A1 | 6/2009 | Desjardins et al. | |
| 2010/0088807 | A1 | 4/2010 | Jeong et al. | |
| 2010/0275337 | A1 | 11/2010 | Bhatnagar et al. | |
| 2010/0287687 | A1 * | 11/2010 | Ho | 2/411 |
| 2011/0271426 | A1 * | 11/2011 | Roesler | 2/410 |
| 2012/0036619 | A1 * | 2/2012 | Ytterborn et al. | 2/411 |

FOREIGN PATENT DOCUMENTS

| | | |
|---|---|---|
| JP | 10130939 | 5/1998 |
| JP | 11036130 A * | 2/1999 |

* cited by examiner

BATTING HELMET HAVING LOCALIZED IMPACT PROTECTION

CROSS-REFERENCE TO RELATED APPLICATIONS

None.

STATEMENT REGARDING FEDERALLY SPONSORED RESEARCH OR DEVELOPMENT

Not applicable.

BACKGROUND OF THE INVENTION

1. Field of the Invention

The present invention relates to protective sports equipment, and more particularly to protective batting helmets used in baseball and softball.

2. Description of Related Art

Protective helmets are commonly used in various sports to provide protection to a player's head. In baseball, for example, players commonly wear batting helmets to provide protection against wild pitches or foul balls. Offensive players also sometimes wear batting helmets when running the bases to protect against injury from hit or thrown balls.

In lower-level leagues, especially those geared to younger players, protective batting helmets are required to be worn by offensive players whenever they are at-bat or on base. Typically, batting helmets include an inner foam core configured to fit on and protect the wearer's head, with an outer protective shell covering the foam core, with the shell extending further downwardly from the inner core, towards the wearer's neck and shoulders. The inner foam core is typically of a substantially uniform thickness, and surrounds the entire upper portion of the wearer's head, extending from the forehead to the rear of the skull, down the sides of the head, and over the wearer's temples. The outer shell is likewise typically of a uniform thickness, surrounding the inner foam core, extending further down the sides and back of the wearer's head than the foam core. The helmet thus provides generally uniform impact protection to all areas of the wearer's head.

BRIEF SUMMARY OF THE INVENTION

The present invention is directed to a batting helmet having localized impact protection, providing additional impact protection to areas of the helmet, typically to areas corresponding to the most vulnerable areas of the wearer's head, such as the temples, forehead, and crown. The helmet includes a rigid shell, with an attached padded inner core providing generally uniform padding and protection to the wearer's head. Localized protection is further provided at various areas on the helmet by providing additional stiffness or strength to the rigid outer shell in those areas or by including additional padding to the inner core or rigid shell in those areas. Thus, the areas of the helmet having localized protection provide an additional level of impact resistance to better deflect, disperse, or absorb impact in those areas to provide improved protection to the wearer. Because of the localized nature of the impact protection, the present invention can be implemented without substantially increasing the overall size and/or weight of a batting helmet.

In a first exemplary embodiment, a batting helmet having localized impact protection comprises a rigid shell having crown, front, back, left and right portions shaped to cover the respective crown, front, back, left and right portions of a wearer's head. A padded inner core, having a substantially uniform thickness, is affixed within the rigid shell so that the padded core covers and generally conforms to the crown, front, back, left, and right portions of a wearer's head. Additional padding is affixed to at least one of the crown, front, back, left, and right portions of the padded core so that a total thickness of padding in that area exceeds the thickness of the padded core alone. The additional padding thus provides localized impact protection to the corresponding area of the wearer's head by providing additional impact-absorbing material in that area. The rigid shell is formed with concave areas (or raised areas, when viewed from the outside) to conform to the additional thickness of the areas of the inner core having additional padding. In an alternative of this embodiment, the rigid shell is formed with areas having an increased thickness (as compared to the nominal thickness of the rigid shell) such that the increased thickness provides greater protection to the wearer. The rigid shell having increased thickness areas may be used in conjunction with a standard inner core or may be used in conjunction with an inner core having additional padding as just described.

In a second exemplary embodiment, a batting helmet having localized impact protection comprises a rigid shell, with a padded inner core affixed therein to cover the crown, front, back, left and right portions of a wearer's head. Additional padding is affixed to the outer surface of the rigid shell in an area corresponding to at least one of the crown, front, back, left, and right portions of the wearer's head, so that a total thickness of padding in that area exceeds the combined thickness of the rigid shell and padded inner core alone the additional padding preferably comprises urethane strips or other impact absorbing material. The additional padding thus provides localized impact protection to the corresponding area of the wearer's head. Alternatively, the additional padding may be affixed to the inner surface of the rigid shell.

In a third exemplary embodiment, a batting helmet having localized impact protection comprises a rigid shell, with a padded inner core affixed therein to cover the crown, front, back, left and right portions of a wearer's head. Material having increased stiffness is positioned upon, or integral to, the rigid shell in an area corresponding to at least one of the crown, front, back, left, and right portions of the wearer's head, so that the total stiffness of material in that area exceeds the stiffness of the rigid shell alone. The material having increased stiffness preferably comprises carbon fiber, and is preferably positioned on the rigid shell as an insert, or by molding the material into the rigid shell. Alternatively, the material having increased stiffness may be attached to the outer or inner surface of the rigid shell in the desired areas. The increased stiffness of the rigid shell in those areas thus provides additional, localized impact protection to the corresponding area of the wearer's head.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

BRIEF DESCRIPTION OF THE DRAWINGS

The present invention will be described in greater detail in the following detailed description of the invention with reference to the accompanying drawings that form a part hereof, in which.

DETAILED DESCRIPTION OF EXEMPLARY EMBODIMENTS

Figure 1:
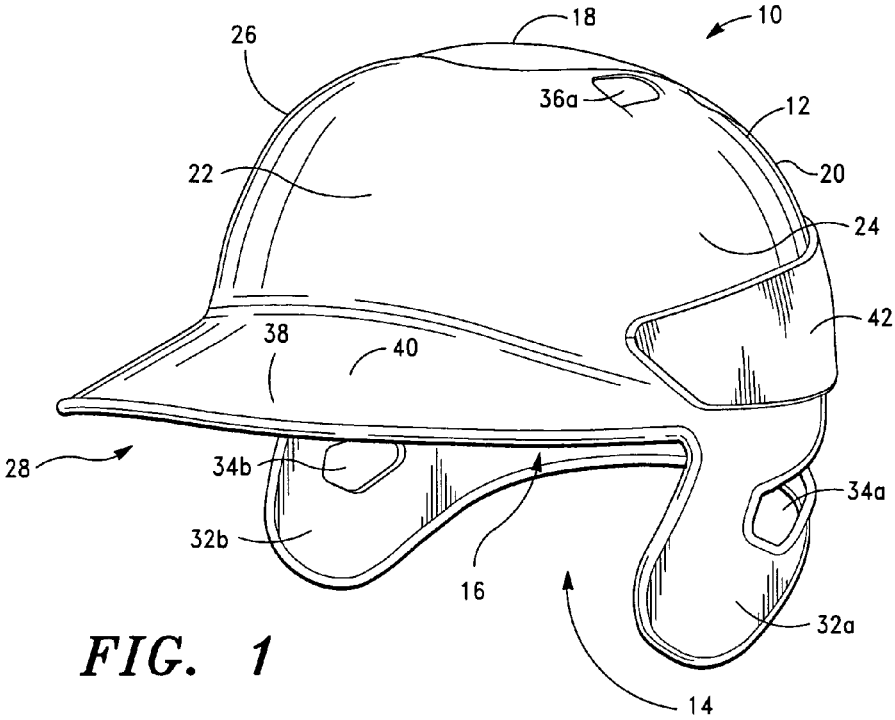
FIG. 1 is a perspective view of a batting helmet with localized impact protection in accordance with a first exemplary embodiment of the present invention.
Figure 2:
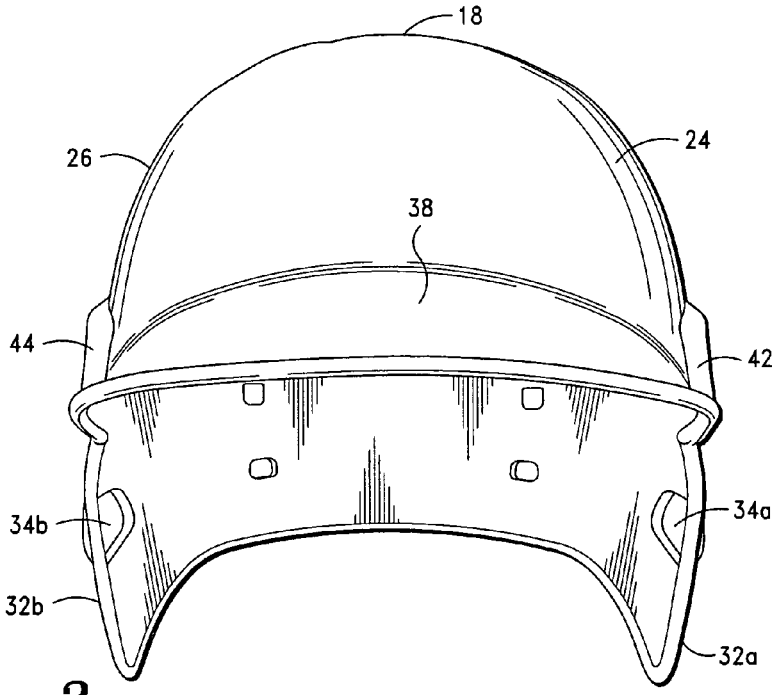
FIG. 2 is a front elevational view of the helmet of FIG. 1.
Figure 3:
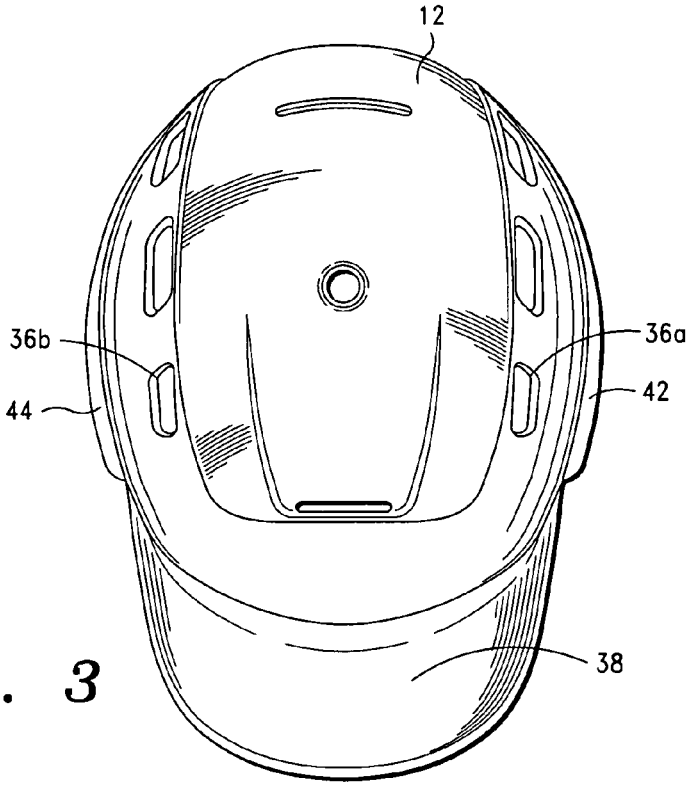
FIG. 3 is a top plan view of the helmet of FIG. 1.

While the invention will be described in detail hereinbelow with reference to various exemplary embodiments, it should be understood that the invention is not limited to the specific configurations shown in these embodiments. Rather, one skilled in the art will appreciate that a variety of configurations may be implemented in accordance with the present invention.

First Exemplary Embodiment

A protective batting helmet having localized impact protection in accordance with a first exemplary embodiment of the present invention is depicted in FIGS. 1 through 4, designated generally by the numeral 10. As shown in FIGS. 1-4, batting helmet 10 comprises a rigid shell 12 having a lower opening 14 at the bottom for placing the helmet over a wearer's head, and an inner cavity 16 configured to receive, and generally conform to, a wearer's head.

Rigid shell 12 includes a crown 18, a back 20, a front 22, a left side 24, and a right side 26, defining a front opening 28 corresponding to the area of the wearer's face, and defining the lower opening 14 for placing the shell over a wearer's head. The crown, front, back, and sides further define the inner cavity 16 which generally conforms to the shape of a wearer's head. Left and right ear covers 32*a*, 32*b* extend downwardly from the left and right sides 24, 26, respectively to cover the wearer's left and right ears, respectively. Left and right ear openings 34*a*, 34*b* through left and right ear covers 32*a*, 32*b*, respectively, provide ventilation to the wearer and allow the wearer to hear while wearing the batting helmet. Ventilation apertures 36*a*, 36*b* along the upper part of left and right side portions 24, 26, near crown 18, allow air circulation into and out of the helmet to cool the wearer's head. A bill 38 extends outwardly from front portion 22 of rigid shell 12 in the area generally corresponding to a wearer's forehead. Bill 38 is oriented to extend slightly upwardly from horizontal in normal wearing position, with the upper surface 40 of bill 38 shaped slightly convex to divert precipitation to the sides of the helmet. Bill 38 extends outwardly from front portion 22 to protect a wearer's eyes from sunlight and precipitation, without unduly limiting the wearer's upward view.

Protruding areas 42, 44 along the left side 24 and right side 26, respectively, provide space within inner cavity 16 for the placement of additional padding, as will be explained in more detail hereinbelow. The left and right protruding areas 42, 44 extend along the sides of the helmet, from a point generally above and forward of the wearer's ears, and wrap back along the sides to the rear of the helmet. The protruding areas 42, 44 are preferably formed integrally with the rigid shell such that the wall thickness of the rigid shell is substantially uniform, and so that the wall thickness of the rigid shell in a non-protruding area is substantially the same as the wall thickness of the rigid shell in a protruding area. The uniform thickness of the rigid shell walls throughout the rigid shell provides manufacturing advantages in molding and curing the shell.

Preferably, rigid shell 12 is constructed from a rigid, impact resistant material. Most preferably, rigid shell 12 is constructed of a rigid plastic material such as Acrylonitrile Butadiene Styrene (ABS) or polycarbonate. Rigid shell 12 is preferably formed as a unitary piece, including bill 38, using known processes such as molding or casting. Rigid shell 12 may be custom manufactured to accommodate head sizes from extra small (6⅜) to extra large (7½), or may be manufactured to intermediate or one-size-fits-all configurations.

Figure 4:
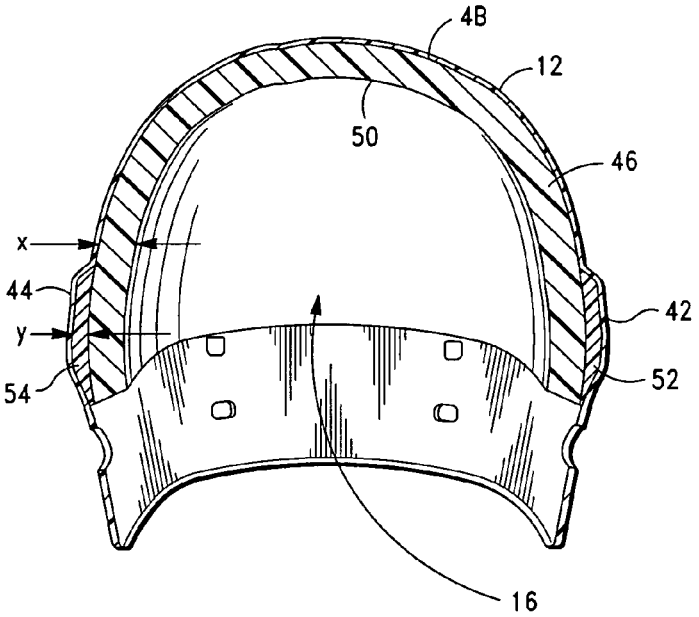
FIG. 4 is a front cross-sectional view of the helmet of FIG. 1.

Looking to FIG. 4, padded inner core 46 is affixed to the top, inner portion of rigid shell 12 from within inner cavity 16. Inner core 46 is generally hemispherical in shape, having an outer surface 48 configured to fit within and conform to the upper portion of rigid shell 12, and an inner surface 50 configured to generally conform to the shape of a wearer's head. The distance between outer surface 48 and inner surface 50 of the inner core defines the thickness of the inner core, designated as line x in FIG. 4. Preferably, the thickness x of the inner core is substantially uniform over the entire inner core. Additional padding 52, 54 is affixed to the padded inner core at areas corresponding to the left side and right side, respectively, of the wearer's head. The additional padding likewise has a thickness, designated as line y in FIG. 4. With the additional padding attached to the inner core, the overall thickness of all padding at that location is x+y (the thickness of the inner core plus the thickness of the additional padding), or greater than the thickness of the inner core alone. Thus, the areas of the inner core having additional padding 52, 54 provide increased impact absorption and correspondingly greater protection from impact to the wearer.

As described above, rigid shell 12 includes protruding areas 42, 44 which define spaces in the inner cavity portion of the shell. As can be seen in FIG. 4, the additional padding 52, 54 is configured to fit within those protruding areas so that the rigid shell conforms closely to the padded inner core in areas not having additional padding, and conforms closely to the additional padding in areas having that padding. Thus, the rigid shell consistently conforms around the inner core and additional padding such that there are no gaps between the rigid shell and the inner core or additional padding.

Padded inner core 46 is preferably constructed from a semi-rigid, impact absorbing or resilient material, such as rubber or foam. Most preferably, padded inner core is made of expandable polystyrene (EPS) or expanded polypropylene (EPP). As described above with respect to rigid shell 12, padded inner core 46 may be custom manufactured to accommodate head sizes from extra small (6⅜) to extra large (8), or may be manufactured to custom, intermediate or one-size-fits-most configurations. Padded inner core 46 may be affixed to the rigid shell using any method known in the art, such as with glue or fasteners. Preferably the inner core is attached to the rigid shell using an adhesive.

Similar to the padded inner core, the additional padding 52, 54 is preferably constructed from a semi-rigid, impact absorbing or resilient material, such as rubber or foam. Most preferably, the additional padding is made of expandable polystyrene. Preferably, the additional padding is affixed to the padded inner core with an adhesive. Most preferably, the additional padding is formed integrally with the padded inner core.

Other configurations and embodiments are within the scope of the present invention. For example, additional padding may be placed only at the temple areas, or only at the crown area of the helmet. Or, additional padding may be placed at other desired locations, such as at the forehead. These and other variations are contemplated by, and within the scope of, the present invention. Likewise, other additional padding material may be used, such that the additional padding and the padded inner core are of different materials. Or, the additional padding, could be positioned on the inside surface of the padded inner core. These variations, too, are within the scope of the present invention.

In addition to the padded inner core and additional padding, the batting helmet may be augmented with various sizes of removable pads attached within rigid shell 12 or to the inner surface of padded inner core 46 to precisely fit the batting helmet to a particular wearer. Any configuration of the helmet may include soft pads or padding at locations within the rigid shell or padded inner core to provide a snug, comfortable fit to the wearer's head as is known in the art.

In an alternative embodiment of the invention as just described with reference to FIGS. 1-4, the thickness of the rigid shell may be increased to provide increased impact protections at areas of the helmet having an increased-thickness rigid shell. For example, referring to FIG. 4, rigid shell 12 may include thicker areas that protrude outwardly from the overall shell as depicted by areas 42 and 44, with the thickness of the portions extending to the inner surface of the shell in areas 52 and 54. Thus, in this alternative embodiment, the thickness of rigid shell 12 at the side portions of the helmet would extend as depicted by "y" in FIG. 4. The increased thickness of the rigid shell provides increased localized impact protection and/or increased stiffness to better disperse impact at those areas of the helmet. It should be understood that the thicker rigid shell portion may be used as an alternative to the additional padding to the inner core as described above, or may be used in conjunction with that embodiment. It should also be understood that the increased thickness of the rigid shell need not protrude outwardly from the outer surface, but my extend inwardly, into the padded inner core of the helmet. In that case, the inner core may include a cut-out or cavity to accommodate the rigid shell, or may simply deflect around the protrusion.

Furthermore, it should be apparent that the increased thickness of the rigid shell need not be dramatic and may be achieved by any increase in the thickness of the rigid shell beyond normal variations allowed in the manufacture of the shell. For example, normal manufacturing tolerances typically permit the nominal thickness of the rigid shell to vary plus or minus ten thousandths of an inch. Any increase of the thickness of rigid shell beyond that manufacturing tolerance is within the scope of the present invention. Preferably, the thickness of the rigid shell at the areas in which increased localized impact protection is desired is approximately at least 0.5 millimeters greater than the nominal thickness of the rigid shell.

Second Exemplary Embodiment

Figure 5:
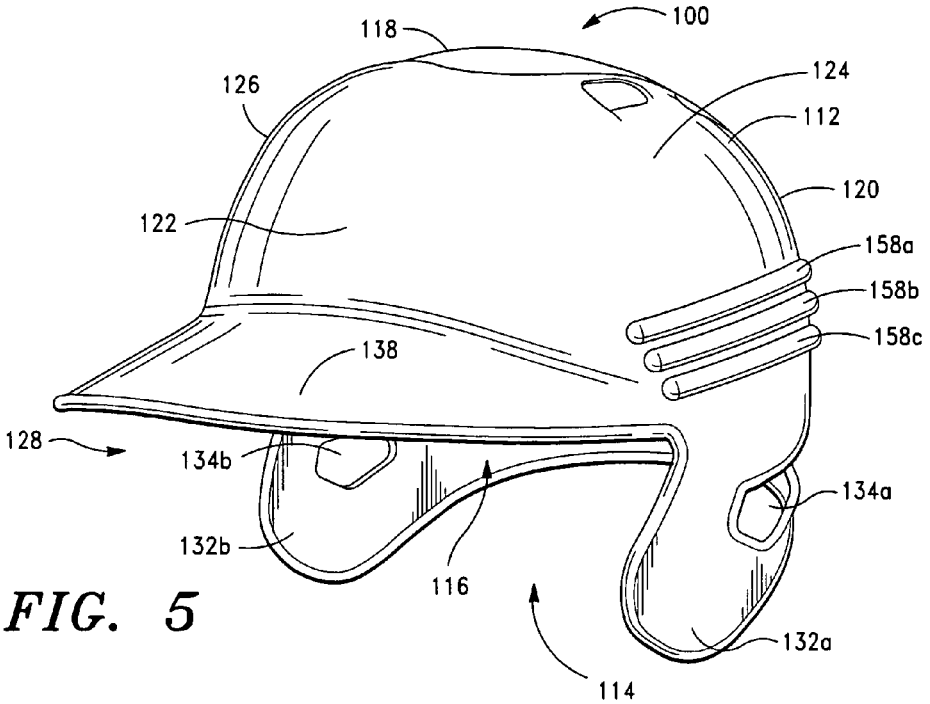
FIG. 5 is a perspective view of a batting helmet with localized impact protection in accordance with a second exemplary embodiment of the present invention.

A protective batting helmet having localized impact protection in accordance with a second exemplary embodiment of the present invention is depicted in FIG. 5, designated generally by the numeral 100. As shown in FIG. 5, batting helmet 100 comprises a rigid shell 112 having a lower opening 114 at the bottom for placing the helmet over a wearer's head, and an inner cavity 116 configured to receive, and generally conform to, a wearer's head.

Rigid shell 112 includes a crown 118, a back 120, a front 122, a left side 124, and a right side 126, defining a front opening 128 corresponding to the area of the wearer's face, and defining the lower opening 114 for placing the shell over a wearer's head. The crown, front, back, and sides further define the inner cavity 116 which generally conforms to the shape of a wearer's head. Left and right ear covers 132*a*, 132*b* extend downwardly from the left and right sides 124, 126, respectively to cover the wearer's left and right ears, respectively. Left and right ear covers 132*a*, 132*b* present left and right ear openings 134*a*, 134*b*, respectively. A bill 138 extends outwardly from front portion 122 of rigid shell 112 in the area generally corresponding to a wearer's forehead.

As described above with respect to the first exemplary embodiment, rigid shell 112 is preferably made from a rigid material, such Acrylonitrile Butadiene Styrene (ABS) or polycarbonate. And, as described previously, rigid shell 112 may be configured in various sizes as desired.

Looking still to FIG. 5, additional padding 158*a*, 158*b*, 158*c* is affixed along each side 124, 126 of rigid shell 112 to provide increased energy absorbing capability to those sides. The additional padding comprises strip of energy absorbing material arranged in a pattern along the side of the helmet. Preferably, additional padding 158*a*, 158*b*, 158*c* is rubber, most preferably it is urethane. The additional padding along the sides of the helmet provides additional protection in those areas to the wearer.

Of course, other variations and configurations of additional padding are contemplated by the present invention. For example, the additional padding may be placed at other areas on the helmet, such as the crown or top of the helmet. Or the additional padding may be arranged in patterns other than the striped-pattern depicted in the exemplary embodiment. The additional padding need not be in strip form, but may be a pad or block, and may be constructed of a material other than urethane. Additionally, the additional padding may be placed on the inside surface of the rigid shell, and may be used whether or not the helmet also includes a padded inner core, as described above with respect to the first exemplary embodiment. Or, as described above with respect to the first exemplary embodiment, the thickness of the rigid shell may be increased at localized areas, that increased-thickness rigid shell may be used in conjunction with the additional padding as just described. These and other variations are within the scope of the present invention.

Third Exemplary Embodiment

Figure 6:
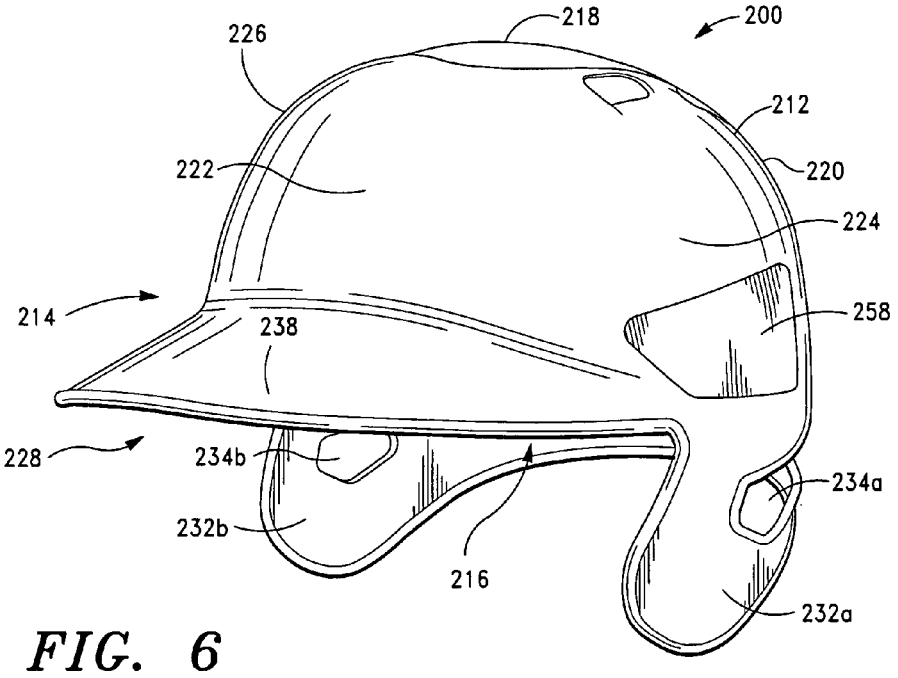
FIG. 6 is a perspective view of a batting helmet with localized impact protection in accordance with a third exemplary embodiment of the present invention.

A protective batting helmet having localized impact protection in accordance with a third exemplary embodiment of the present invention is depicted in FIG. 6, designated generally by the numeral 200. As shown in FIG. 6, batting helmet 200 comprises a rigid shell 212 having a lower opening 214 at the bottom for placing the helmet over a wearer's head, and an inner cavity 216 configured to receive, and generally conform to, a wearer's head.

Rigid shell 212 includes a crown 218, a back 220, a front 222, a left side 224, and a right side 226, defining a front opening 228 corresponding to the area of the wearer's face, and defining the lower opening 214 for placing the shell over a wearer's head. The crown, front, back, and sides further define the inner cavity 216 which generally conforms to the shape of a wearer's head. Left and right ear covers 232*a*, 232*b* extend downwardly from the left and right sides 224, 226, respectively to cover the wearer's left and right ears, respectively. Left and right ear covers 232*a*, 232*b* present left and right ear openings 234*a*, 234*b*, respectively. A bill 238 extends outwardly from front portion 222 of rigid shell 212 in the area generally corresponding to a wearer's forehead.

As described above with respect to the first exemplary embodiment, rigid shell 212 is preferably made from a rigid material, such Acrylonitrile Butadiene Styrene (ABS) or polycarbonate. And, as described previously, rigid shell 212 may be configured in various sizes as desired.

Looking still to FIG. 6, a material 258 having a stiffness greater than that of the majority portion of rigid shell 212 is positioned along each side 224, 226 of rigid shell 212 to present an increased stiffness of material in those sides. Preferably, the material having increased stiffness is positioned within a recess, insert area, or cavity formed in the rigid shell so that the material lies flush with the outer-surface of rigid shell 212. Alternatively, the material having increased stiffness may be molded within rigid shell 212, or may be co-molded or over-molded in place on or within rigid shell 212. Or, the material may be adhered to the outer surface of rigid shell 212, the inner surface of rigid shell 212, or both. Preferably, the material having increased stiffness comprises a lightweight, minimally deflectable material. Most preferably, the material comprises carbon fiber. As seen in FIG. 6, material having increased stiffness 258 arranged along the sides of the rigid shell provides localized impact protection to the wearer in those areas.

Of course, other variations and configurations of including material having increased stiffness in rigid shell 212 are contemplated by the present invention. For example, the material may be included at other areas of the helmet, such as the crown portion of the helmet. Or, the area of increased stiffness 258 may be achieved by providing an area of rigid shell 212 having an increased thickness (e.g., a thicker portion of Acrylonitrile Butadiene Styrene (ABS) in the desired area) such that the area has a greater stiffness than the other portions of rigid shell 212, with the increased thickness portion extending outwardly or inwardly from rigid shell 212. Or the increased stiffness material may be arranged in patterns along the helmet. And, as described previously, the material may be molded within or upon the rigid shell, or may be adhered to the rigid shell in the desired areas. Additionally, the increased stiffness material may be placed on the inside surface of the rigid shell, and may be used whether or not the helmet also includes a padded inner core. These and other variations are within the scope of the present invention As can be seen, the invention described herein provides a batting helmet having localized impact protection that provides greater protection to a wearer. Because the added impact protection is localized, the invention does not substantially increase the size or the weight of the overall helmet. Thus, a wearer receives the benefit of localized impact protection without incurring increased overall size and/or weight of the helmet. While the invention has been described in conjunction with various exemplary embodiments, other embodiments or configurations are contemplated by and within the scope of the present invention. It should be understood that the invention described herein includes numerous features that have been described in conjunction with various exemplary embodiments. That those features may be arranged in various combinations, whether or not disclosed in a single embodiment herein, is contemplated by the present invention.

The term "substantially" or "approximately" as used herein may be applied to modify any quantitative representation which could permissibly vary without resulting in a change in the basic function to which it is related. For example, the wall thickness of the rigid shell 12 is described as being substantially uniform, but may permissibly vary from that diameter if the variance does not materially alter the capability of the invention.

While the present invention has been described and illustrated hereinabove with reference to various exemplary embodiments, it should be understood that various modifications could be made to these embodiments without departing from the scope of the invention. Therefore, the invention is not to be limited to the exemplary embodiments described and illustrated hereinabove, except insofar as such limitations are included in the following claims.

What is claimed and desired to be secured by Letters Patent is as follows:

1. A batting helmet having localized impact protection, comprising:

a rigid shell comprising crown, front, back, left and right portions shaped to cover the respective crown, front, back, left and right portions of a wearer's head, at least one ear cover extending downwardly from one of said left and right portions, and a bill extending outwardly from said front portion, said shell defining a bottom opening and an inner cavity for receiving said wearer's head, wherein said rigid shell is substantially comprised of a material having a first stiffness, and wherein said rigid shell comprises inner and outer surfaces;

a padded core having a substantially uniform thickness affixed within said rigid shell, said padded core comprising crown, front, back, left, and right portions configured to cover the respective crown, front, back, left, and right portions of a wearer's head, said padded core comprising an inner surface positioned to contact said wearer's head and an outer surface configured to fit within said inner cavity of said rigid shell; and a sheet of protective material having a second stiffness attached to said inner surface of said rigid shell only in an area corresponding to at least one of said left and right portions of said rigid shell, wherein said second stiffness is greater than said first stiffness to provide increased impact protection to said wearer only along said area corresponding to at least one of said left and right portions, and wherein said sheet of protective material does not extend along said crown portion of said rigid shell, said front portion of said rigid shell, or said back portion of said rigid shell.

2. The batting helmet of claim 1, wherein said protective material comprises carbon fiber.

3. The batting helmet of claim 1, wherein said protective material is integral to said rigid shell such that a thickness of said rigid shell in said area having protective material is substantially the same as a thickness of said rigid shell in an area without said protective material.

4. The batting helmet of claim 1, wherein said protective material is molded integrally with said rigid shell.

5. The batting helmet of claim 1, wherein said protective material is placed on said inner surface of said rigid shell.

6. The batting helmet of claim 1, wherein said protective material is adhered to said inner surface of said rigid shell.

7. The batting helmet of claim 1, wherein said protective material is molded within or upon the rigid shell.

8. The batting helmet of claim 1, wherein said protective material is positioned within a recess, insert area, or cavity formed in said rigid shell.

9. The batting helmet of claim 1, wherein said protective material is co-molded or over-molded in place on or within said rigid shell.

10. A batting helmet having localized impact protection, comprising:

a rigid shell having an outer surface, crown, front, back, left and right portions shaped to cover the respective crown, front, back, left and right portions of a wearer's head, at least one ear cover extending downwardly from one of said left and right portions, and a bill extending outwardly from said front portion, said shell defining a bottom opening and an inner cavity for receiving a wearer's head, a material of said rigid shell having a first stiffness; and a sheet of protective material having a second stiffness positioned upon or integral to said rigid shell and extending substantially continuously only along at least one of said left or right portions from adjacent said front portion to adjacent said back portion, wherein said second stiffness is greater than said first stiffness to provide increased impact protection only along said at least one of said left or right portions, and wherein said sheet of protective material does not extend along said crown portion of said rigid shell, said front portion of said rigid shell, or said back portion of said rigid shell.

11. The batting helmet of claim 10, wherein said protective material comprises carbon fiber.

12. The batting helmet of claim 11, wherein said protective material is integral to said rigid shell.

13. The batting helmet of claim 10, wherein said protective material is placed on an inside surface of said rigid shell.

14. The batting helmet of claim 10, wherein said protective material is adhered to an inner surface of said rigid shell.

15. The batting helmet of claim 10, wherein said protective material is attached to an outer or inner surface of said rigid shell.

16. The batting helmet of claim 10, wherein said protective material is molded within or upon the rigid shell.

17. The batting helmet of claim 10, wherein said protective material is positioned within a recess, insert area, or cavity formed in said rigid shell.

18. The batting helmet of claim 10, wherein said protective material is co-molded or over-molded in place on or within said rigid shell.

* * * * *